United States Patent [19]

Gachsay

[11] Patent Number: 4,572,245

[45] Date of Patent: Feb. 25, 1986

[54] ELECTROTHERMAL FABRIC MELT CUTTER FOR A WEAVING MACHINE

[75] Inventor: Lorant Gachsay, Zurich, Switzerland

[73] Assignee: Sulzer Brothers Limited, Winterthur, Switzerland

[21] Appl. No.: 612,859

[22] Filed: May 22, 1984

[30] Foreign Application Priority Data

May 27, 1983 [DE] Fed. Rep. of Germany ..... 3319194

[51] Int. Cl.[4] ..... D03D 49/00

[52] U.S. Cl. ..... 139/291 C; 139/302

[58] Field of Search ..... 139/291 C, 429, 302, 139/303; 26/7; 156/380.7, 515; 83/860, DIG. 1

[56] References Cited

U.S. PATENT DOCUMENTS

| | | | |
|---|---|---|---|
| 3,961,650 | 6/1976 | Marowsky | 139/291 C |
| 4,396,449 | 8/1983 | Tumminia | 156/515 |
| 4,467,686 | 8/1984 | Pyle | 83/860 |

FOREIGN PATENT DOCUMENTS

| | | | |
|---|---|---|---|
| 6702938 | 10/1967 | Netherlands | 139/291 C |

*Primary Examiner*—Henry S. Jaudon

*Attorney, Agent, or Firm*—Kenyon & Kenyon

[57] ABSTRACT

A shield is provided upstream of the heating wire of the electrothermal fabric melt cutter to prevent cooling of the heating wire by a fanning action of the reed during beating-up. The shield extends to the fabric and may have a cover for further supporting the fabric during movement past the heating wire of the cutter.

10 Claims, 3 Drawing Figures

ELECTROTHERMAL FABRIC MELT CUTTER FOR A WEAVING MACHINE

This invention relates to an electrothermal fabric melt cutter for a weaving machine.

Heretofore, it has been known to provide weaving machines with electrothermal fabric melt cutters for severing a moving web of fabric into separate strips prior to winding up on a take-up roll. For example, an electrothermal fabric melt cutter as described in German O.S. No. 1535330 includes a heating wire which is disposed in the path of a moving fabric downstream of a reed and upstream of a take-up roll in order to sever the fabric. However, one disadvantage of this cutter is that the fanning action of the reed at each beating-up cools the heating wire. Hence, the electrical consumption of the wire is greater than necessary for satisfactory severance of the fabric.

Accordingly, it is an object of the invention to provide an electrothermal fabric melt cutter which does not require an excessive electrical consumption for cutting purposes.

It is another object of the invention to prevent the fanning action of a reed in a weaving machine from effecting the efficiency of an electrothermal fabric melt cutter.

Briefly, the invention provides an electrothermal fabric melt cutter for a weaving machine which comprises a heating wire for serving a moving fabric web and a shield which is disposed about the heating wire to shield the wire from reed-induced air flows.

The fabric melt cutter is disposed in a weaving machine having a reed for beating-up a weft yarn into a fabric and a fabric take-up roll. In this respect, the heating wire of the cutter is disposed between the reed and the roll for severing the fabric into strips during movement towards the take-up roll. In addition, the shield is disposed between the heating wire and the reed in order to shield the wire from the reed-induced air flows.

The shield is constructed to extend to the path of the fabric to the take-up roll so as to not only shield the heating wire but also to permit the traveling fabric to be supported thereon.

In one embodiment, the shield is provided with a cover which extends parallel and adjacent to the path of the fabric in order to support the fabric with the wire projecting into path of the fabric.

These and other objects and advantages of the invention will become more apparent from the following description taken in conjunction with accompanying drawings wherein.

Figure 1:
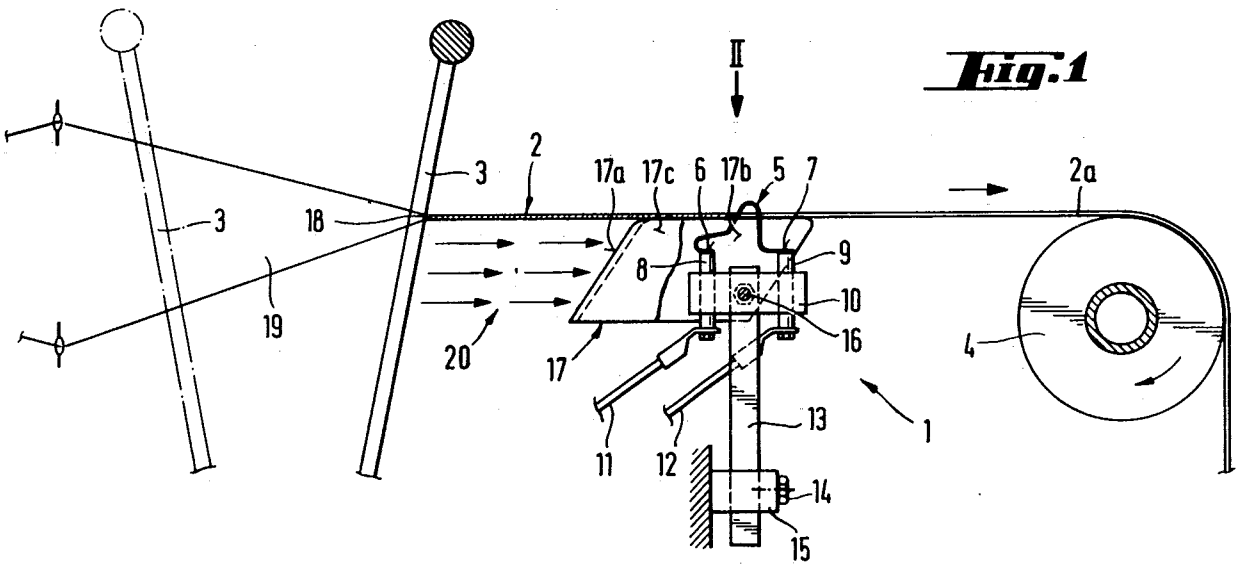
FIG. 1 illustrates a side view of a cutter and shield according to the invention within a weaving machine.

Referring to FIG. 1, the electrothermal fabric melt cutter 1 is disposed in a weaving machine below a fabric 2 and between a reed 3 for beating-up a weft yarn into the fabric 2 and a fabric take-up roll 4.

The cutter 1 includes a heating wire 5 which serves to sever the moving fabric web 2 into two webs 2*a*, 2*b* (see FIG. 2) as the fabric moves in the take-up direction. As indicated, the webs 2*a*, 2*b* are coiled separately on the take-up roll 4. The wire 5 is secured at two ends to terminal pins 8, 9, respectively. The pins 8, 9 are, in turn, disposed in an insulating block 10 and connected by wires 11, 12 to a power supply (not shown). In addition, the insulating block 10 is mounted on a bar 13 which is secured by a screw 14 to a holder 15.

Figure 2:
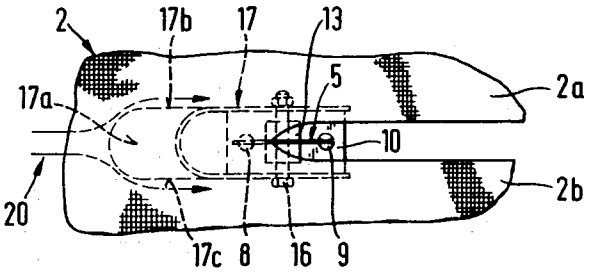
FIG. 2 illustrates a plan view of the cutter and shield.

A shield 17 of U-shape has a pair of arms 17*b*, 17*c* which envelope the wire 5 and which are secured to the insulating block 10 by suitable means such as a screw connection 16. As indicated in FIGS. 1 and 2, a sloped forward wall 17*a* connects the arms 17*b*, 17*c* and, together with the arms, envelops the wire 5. As shown in FIG. 1, the wire 5 projects from above the plane of the shield 17.

When the weaving machine is in operation, whenever the reed 3 moves towards an apex 18 of a shed 19 during beating-up of a weft (not shown), the shield 17 is so disposed to insure that the air flow 20 caused by the reed 3 can reach neither the operative zone of the wire 5 nor the wire 5 itself. Thus, the shield 17, in protecting the wire 5 from air flows from the reed 3, insures that there are no unwanted temperature variations of the wire 5.

Advantageously, the shield 17 extends to the path of the fabric 2, i.e., to the bottom of a fabric 2 as view in FIG. 1 so as to support the fabric 2. The fabric 2 is then always positioned at the correct height relative to the heating wire 5 even if the plane of the fabric 2 alters because the fabric is being sensed or after a stoppage and a restart of the weaving machine.

Figure 3:
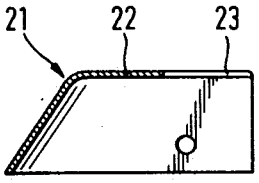
FIG. 3 illustrates a modified shield according to the invention.

Referring to FIG. 3, the shield 21 may alternatively be screened on the fabric side by a cover 22. In this case, the cover 22 would extend parallel and adjacent to the path of the fabric while further supporting the fabric thereon. In addition, the cover 22 can be formed with a slot 23 or an aperture for the heating wire (not shown) to extend through. This shield 21 insures that very fine fabric is not damaged during sliding over the top edge of the shield. The use of the cover 22 also insures that, when wide-mesh textures are being woven, the air flow produced by the reed 3 above the fabric does not affect the wire 5 and the environment of the wire so as to impair heating.

Of note, while the shield 17 has been described as being secured to the cutter 1, the shield can, of course, be secured to some other nearby part of the weaving machine.

The invention thus provides an electrothermal fabric melt cutter which can be efficiently heated and utilized with a minimum of electrical consumption. Further, the provision of the shield precludes the fanning action of a reed from affecting the operation and electrical consumption of the heating wire.

What is claimed:

1. An electrothermal fabric melt cutter for a weaving machine comprising a heating wire having a severing portion for severing a moving fabric web; and a shield disposed about said heating wire to shield said severing portion of said wire from reed-induced air flows.

2. In a weaving machine having a reed for beating-up a weft yarn into a fabric and a fabric take-up roll, the combination of a heating wire between said reed and said roll having a severing portion for severing a fabric moving towards said roll; and a shield disposed between said heating wire and said reed to shield said severing portion of said wire from reed-induced air flows.

3. The combination as set forth in claim 2 wherein said shield is of U-shape with a pair of arms enveloping said wire.

4. The combination as set forth in claim 3 wherein said shield has a sloped forward wall connecting said arms.

5. The combination as set forth in claim 3 wherein said shield extends to the path of the fabric to said roll to support the fabric thereon.

6. The combination as set forth in claim 3 wherein said shield has a cover extending parallel and adjacent to the path of the fabric to said roll to support the fabric thereon with said wire projecting into said path.

7. The combination as set forth in claim 2 which further comprises an insulating block mounting said wire thereon with said shield secured to said block.

8. An electrothermal fabric melt cutter comprising a heating wire for severing a moving fabric in a weaving machine into separate webs; and a shield enveloping said wire with said wire projecting from said shield, said shield being disposed to protect said wire from air flows from a reed of the weaving machine.

9. A cutter as set forth in claim 8 wherein said cutter includes an insulating block mounting said wire therein and means securing said shield to said block.

10. A cutter as set forth in claim 9 wherein said shield has a pair of arms secured to said block and sloped forward wall connecting said arms.

* * * * *